US007673709B2

(12) United States Patent
Felderhoff et al.

(10) Patent No.: US 7,673,709 B2
(45) Date of Patent: Mar. 9, 2010

(54) EARTH-BORING BIT WITH SHEAR CUTTING ELEMENTS

(75) Inventors: Floyd C. Felderhoff, Montgomery, TX (US); Rudolf Carl Pessier, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 633 days.

(21) Appl. No.: 11/393,298

(22) Filed: Mar. 30, 2006

(65) Prior Publication Data

US 2006/0219442 A1 Oct. 5, 2006

Related U.S. Application Data

(60) Provisional application No. 60/666,426, filed on Mar. 30, 2005.

(51) Int. Cl.
*E21B 10/52* (2006.01)

(52) U.S. Cl. ..... 175/426; 175/430

(58) Field of Classification Search ..... 175/77, 175/378, 430, 428, 426
See application file for complete search history.

(56) References Cited

U.S. PATENT DOCUMENTS

| | | | | |
|---|---|---|---|---|
| 6,000,483 | A * | 12/1999 | Jurewicz et al. | 175/428 |
| 6,241,035 | B1 * | 6/2001 | Portwood | 175/374 |
| 6,672,406 | B2 * | 1/2004 | Beuershausen | 175/57 |
| 6,929,079 | B2 * | 8/2005 | McDonough et al. | 175/420.1 |
| 7,013,999 | B2 * | 3/2006 | Tufts | 175/430 |
| 7,040,424 | B2 * | 5/2006 | Yong et al. | 175/374 |
| 7,086,489 | B2 * | 8/2006 | McDonough | 175/430 |
| 2003/0051922 | A1 * | 3/2003 | Baker et al. | 175/374 |
| 2003/0136588 | A1 * | 7/2003 | Truax et al. | 175/376 |
| 2006/0219442 | A1 * | 10/2006 | Felderhoff et al. | 175/331 |

* cited by examiner

*Primary Examiner*—Shane Bomar
(74) *Attorney, Agent, or Firm*—Bracewell & Giuliani LLP

(57) ABSTRACT

An earth-boring bit has a bit body and at least one cone for rotation relative to the bit body. The cone has a gage surface and a nose area separated by a central area. A nose insert is located in the nose area. The nose insert has a barrel located within a hole in the nose area and an outer end protruding from the cone, the outer end has a perimeter that is a plane perpendicular to a barrel axis of the nose insert.

14 Claims, 6 Drawing Sheets

EARTH-BORING BIT WITH SHEAR CUTTING ELEMENTS

CROSS-REFERENCE TO RELATED APPLICATION

This application claims priority to provisional patent application 60/666,426 filed Mar. 30, 2005.

FIELD OF THE INVENTION

This invention relates in general to rotating cone earth-boring bits, and in particular to a bit having flat-top shear cutting inserts.

BACKGROUND OF THE INVENTION

A typical rolling cone earth-boring bits has a bit body that rotatably supports three cones. Each of the cones has a gage surface, a central area and a nose area. The central area contains at least two rows of cutting elements. The nose area also contains one or more cutting elements. The cutting elements may be integrally formed with the cone metal or they may be hard metal inserts installed within mating holes formed in the cone. Bits utilizing inserts typically have gage inserts fitted within mating holes on the gage surface.

Both the cutting elements in the central area and the nose area may have a variety of shapes. Common shapes for inserts used in these areas include hemispherical, ovoid and chisel-shaped. The central area cutting elements typically disintegrate rock by crushing action. The outermost row of central area cutting elements, called the heel row, disintegrate rock by both a crushing and shearing mode. The nose cutting elements also disintegrate by both a crushing and shearing mode.

The gage inserts typically engage the sidewall of the borehole in shearing action. These inserts have flat tops or outer ends, typically bounded by conical bevels. The flat outer ends are located in a plane parallel with the gage surface, when viewed in cross-section.

SUMMARY

The bit of this invention has a nose cutting element in the nose area of each of the cones. The nose cutting element has a flat outer end. The nose cutting element is located closer to the bit axis than any other cutting elements on the cone. Preferably, the nose cutting element has an axis of symmetry, and the outer end is located in a plane perpendicular to the axis of symmetry. The outer end is bounded by a symmetrical conical area or bevel in the preferred embodiment.

Preferably the axis of each nose cutting element is inclined relative to the cone axis at an angle in the range from 0 to 35 degrees. The nose cutting element may be integrally formed with the metal of the cone or comprise an insert with a cylindrical barrel installed within a mating hole in the cone.

DETAILED DESCRIPTION OF THE INVENTION

Figure 1:
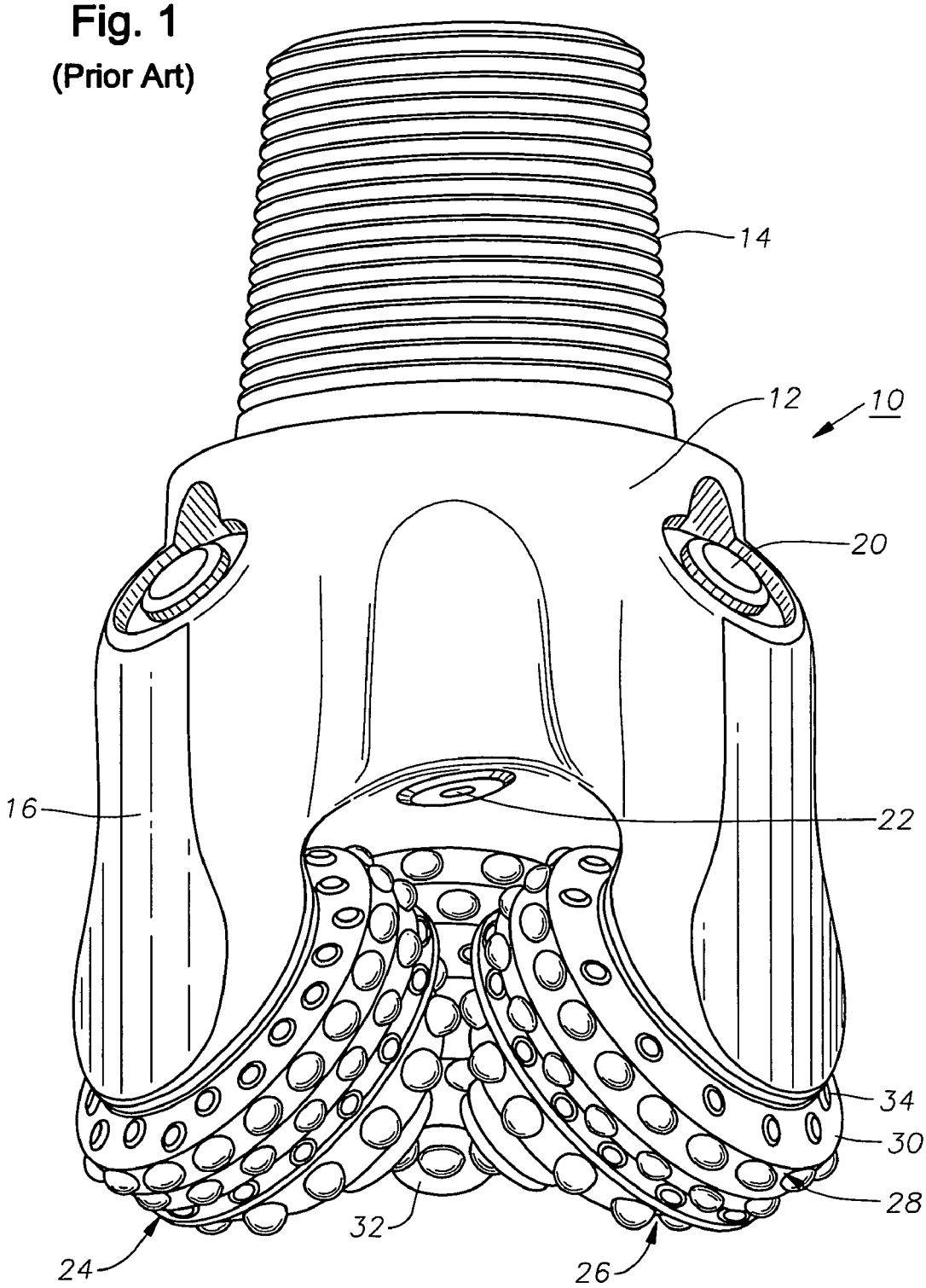
Fig. 1 (Prior Art)
FIG. 1 is a side elevational view of a prior art earth-boring bit.

FIG. 1 illustrates a prior art earth-boring bit 10 of the three cone roller bit variety. Bit 10 includes a bit body 12 having a threaded pin-type connector 14 at its upper end for securing to the lower end of a drill string (not shown). Bit body 12 has three downward depending legs 16 with a lubricant compensator 20 provided for each. Nozzles 22 (one shown) are positioned between each of the adjacent legs 16 to dispense drilling fluid during drilling. The drilling fluid is pumped down the drill string and into a cavity (not shown) in bit body 12.

A rolling cone 24 is rotatably secured to the lower end of each of the three legs. Each cone 24 has a plurality of inserts 26, each of which is typically a tungsten carbide member press-fitted into a mating hole. Inserts 26 are located in circumferential rows and have protruding ends that are normally dome-shaped or chisel-shaped. Each cone 24 has a heel surface 28, which contains the outermost row of inserts 26, and a gage surface 30. Gage surface 30 is a conical surface located radially outward from heel surface 28. Typically, each cone 24 has a plurality of gage inserts 34 mounted in gage surface 30. Gage inserts 34 have flat tops that protrude slightly from gage surface 30 and are normal to the side wall of the bore hole. Each cone 24 also has a nose area 32, which is a blunted apex of each cone 24. In the prior art, one or more dome-shaped inserts 26 are mounted to nose area 32.

Figure 2:
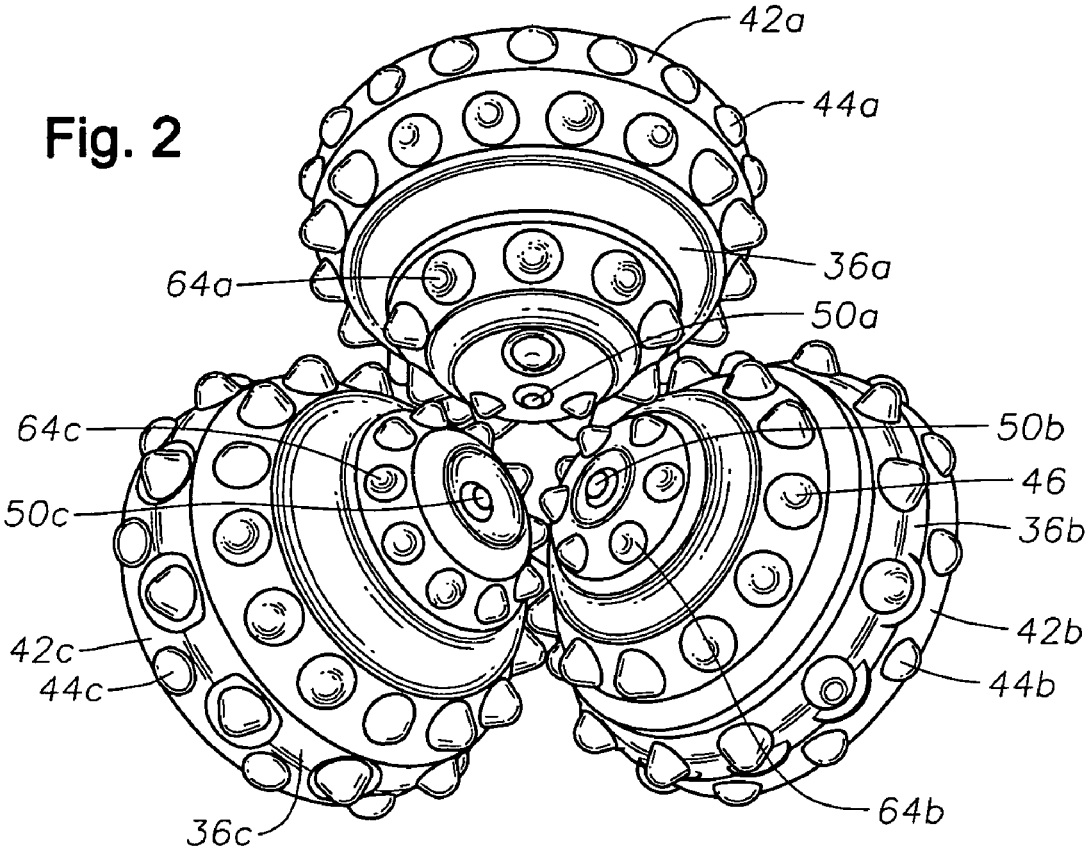
FIG. 2 is a bottom view of the cones of an earth-boring bit constructed in accordance with this invention.
Figure 3:
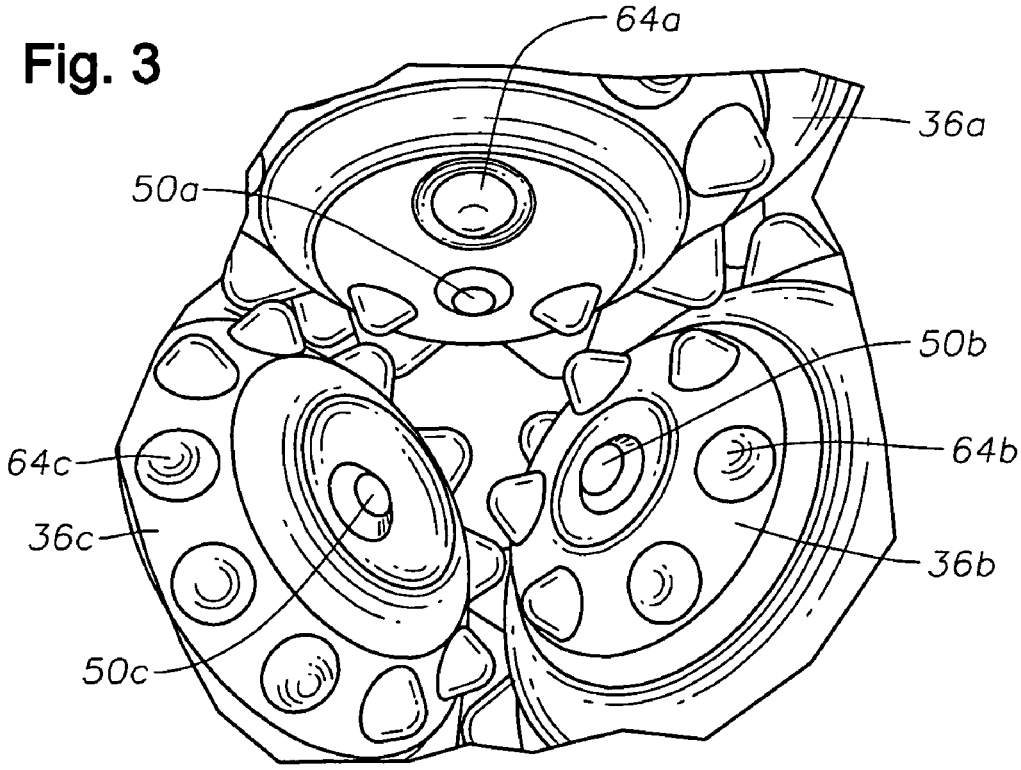
FIG. 3 is an enlarged bottom view of a portion of the cones of FIG. 2.

Referring to FIGS. 2 and 3, in this invention, cones 36*a*, 36*b*, and 36*c* (also referred to as cones 36) are used rather than cones 26 of FIG. 1 for certain drilling conditions. Each cone 36 has a heel row land 42 containing heel row inserts 44 for cutting the borehole bottom and part of the sidewall of the bore hole. When cones 36 are rotated, heel row inserts 44 will cut the corner of the bore hole between the side wall and bottom. Each heel row insert 44 reaches the gage or full diameter of the bit as cones 36 rotate. Each cone 36 has a plurality of inner row inserts 46. Heel row inserts 44 and inner row inserts 46 are conventional and may have a variety of sizes and shapes. Each cone 36 has at least one nose insert 50 in the preferred embodiment.

Figure 4:
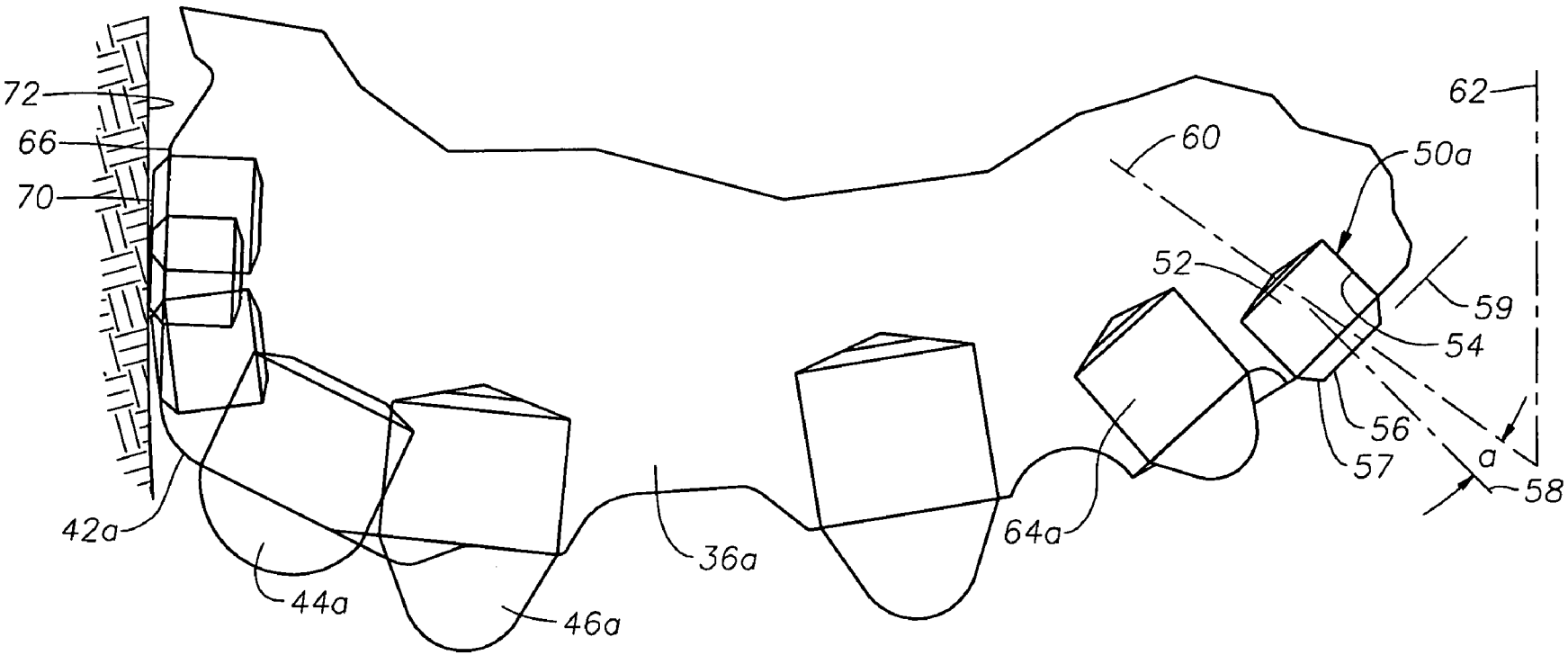
FIG. 4 is a sectional layout of one of the cones of FIG. 2.
Figure 5:
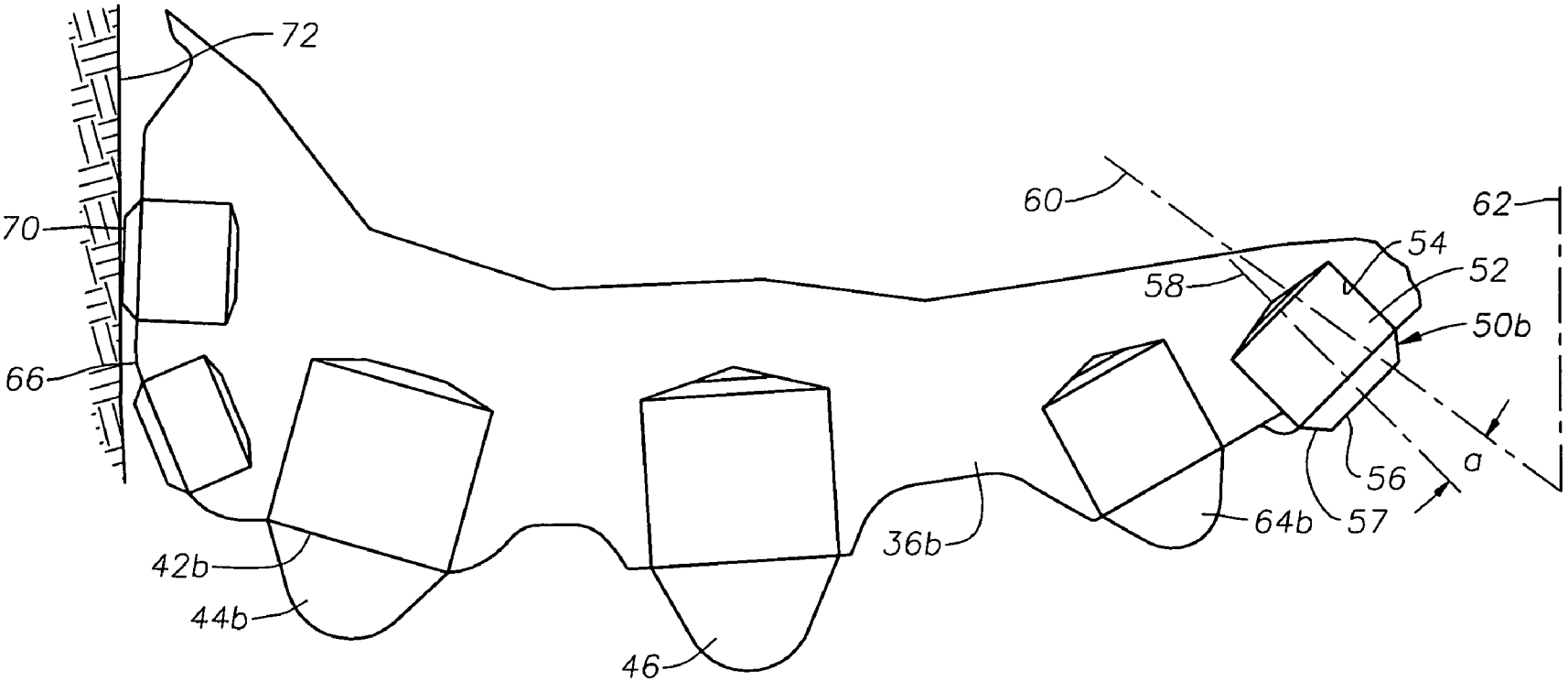
FIG. 5 is a sectional layout of another of the cones of FIG. 2.
Figure 6:
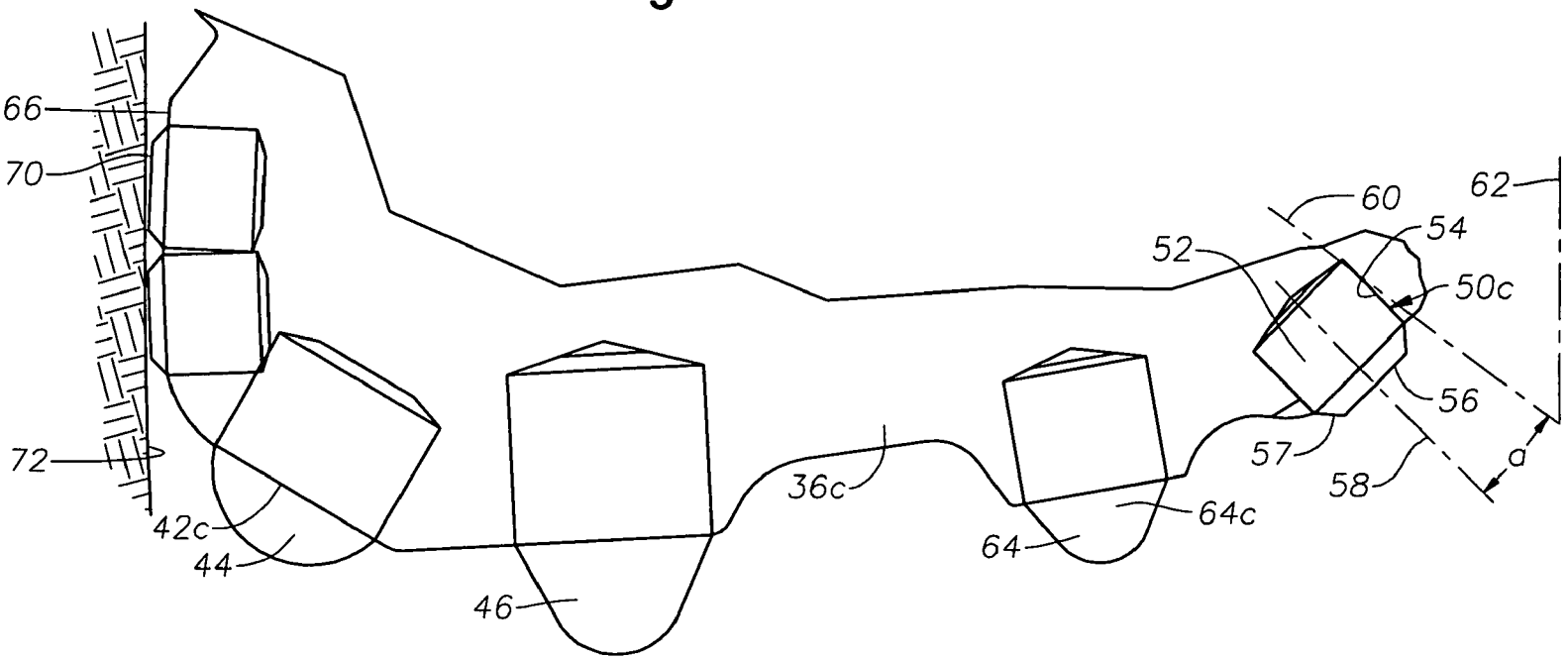
FIG. 6 is a sectional layout of the third cone of FIG. 2.

FIGS. 4, 5 and 6 show cones 36*a*, 36*b*, and 36*c*, respectively, in cross-sectional layouts, with all of the inserts of each cone 36 rotated into the same sectional plane. The suffixes a, b and c are used with numerals of the some of the components of cones 36 to signify on which cone 36*a*, 36*b* or 36*c* a particular component is located. As shown in FIG. 4, cone 36*a* has a single nose insert 50*a* that has a cylindrical base or barrel 52 press-fitted into a mating hole 54. Nose insert 50*a* performs mostly shearing action on the earth formation due to rotation of the bit about bit axis 62.

A conical surface or bevel 57 joins barrel 52 and protrudes from hole 54. In the example shown, bevel 57 has straight sides when viewed in a vertical sectional plane, thus has a straight frusto-conical shape. Alternately, the conical surface could be rounded with the sides curved be curved when viewed in the vertical sectional plane. An outer end 56 joins conical bevel 57. Outer end 56 has a circular perimeter in this embodiment, and a plane 59 passing through the circular perimeter is perpendicular to barrel axis 58. In this embodiment, outer end 56 is flat. Barrel axis 58 also passes through the centerpoint of outer end 56. The axial length of bevel 57 is much smaller than the axial length of barrel 52, thus outer end 56 does not protrude from hole 54 as much as any of the heel row or inner row inserts 44, 46. Preferably barrel 52 is formed of a material such as tungsten carbide, and outer end 56 comprises a polycrystalline diamond layer or another hard material. In this example, nose insert 50*a* has the same configuration as gage inserts 34 of the prior art bit of FIG. 1.

Barrel axis 58 of nose insert 50*a* appears in a cross-sectional layout at an acute angle a with respect to the cone axis of rotation 60, although it does not necessarily intersect cone axis 60. When rotated into the same sectional plane, angle a is from zero to 35 degrees relative to cone axis 60. At zero degrees, barrel axis 58 would be parallel to cone axis 60. Cone axis 60 is at a conventional angle, about 32 to 39 degrees, relative to a line perpendicular to the bit axis of rotation 62. A smaller angle a causes nose insert 50*a* to perform more shearing action, while a larger angle a increases crushing action. Preferably angle a is selected to cause mostly shearing action.

Nose insert 50*a* is the insert of cone 36*a* closest to bit axis 60 and closest to the apex of cone 36. Nose insert 50*a* is not located precisely on the cone apex on cone axis 60 in this embodiment, but it is spaced closer to cone axis 60 than nose inserts 50*b* and 50*c* (FIGS. 5 and 6) of cones 36*b* and 36*c*.

An innermost row 64*a* on cone 36*a* comprises three inserts concentric about cone axis 60 and surrounding nose insert 50*a*. Innermost row inserts 64*a* in this embodiment are dome-shaped, however, inner row inserts 64*a* may have other configurations than dome-shaped, such as chisel-shaped, but the cutting portions will protrude farther than nose insert 50*a*. Alternately, the innermost row inserts 64*a* could have the same configuration as nose inserts 50*a*, 50*b* and 50*c*.

Referring to FIG. 5, nose insert 50*b* has the same configuration as nose insert 50*a* of FIG. 4. Nose insert 50*b* is spaced slightly further from cone axis 60 than in FIG. 4. Barrel axis 58 is at an acute angle a relative to cone axis 60 in this sectional layout view that is slightly greater than in FIG. 4, but within the same range. Innermost row 64*b* is spaced slightly farther from nose insert 50*b* than in FIG. 4. Also, in this embodiment, there are six innermost row inserts 64*b*, rather than three as in cone 36*a* (FIG. 4).

Referring to FIG. 6, in this embodiment, nose insert 50*c* has the same configuration as nose inserts 50*a* and 50*b* (FIGS. 4 and 5). Nose insert 50*c* has a greater angle a than inserts 50*a* and 50*b* relative to cone axis 60 but within the same range of zero to 35 degrees. Nose insert 50*c* is spaced slightly farther from cone axis 60 when viewed in a sectional layout as in FIG. 6. The innermost row 64*c* is spaced farther from nose insert 50*c* than the other cones and preferably contains 10 inserts.

Referring FIGS. 4-6, each cone 36*a*, 36*b* and 36*c* has a gage surface 66. Gage surface 66 has one or more rows of gage inserts 70. Each gage insert 70 has a flat outer end and the same general configuration as nose inserts 50*a*, 50*b* and 50*c*.

Figure 8:
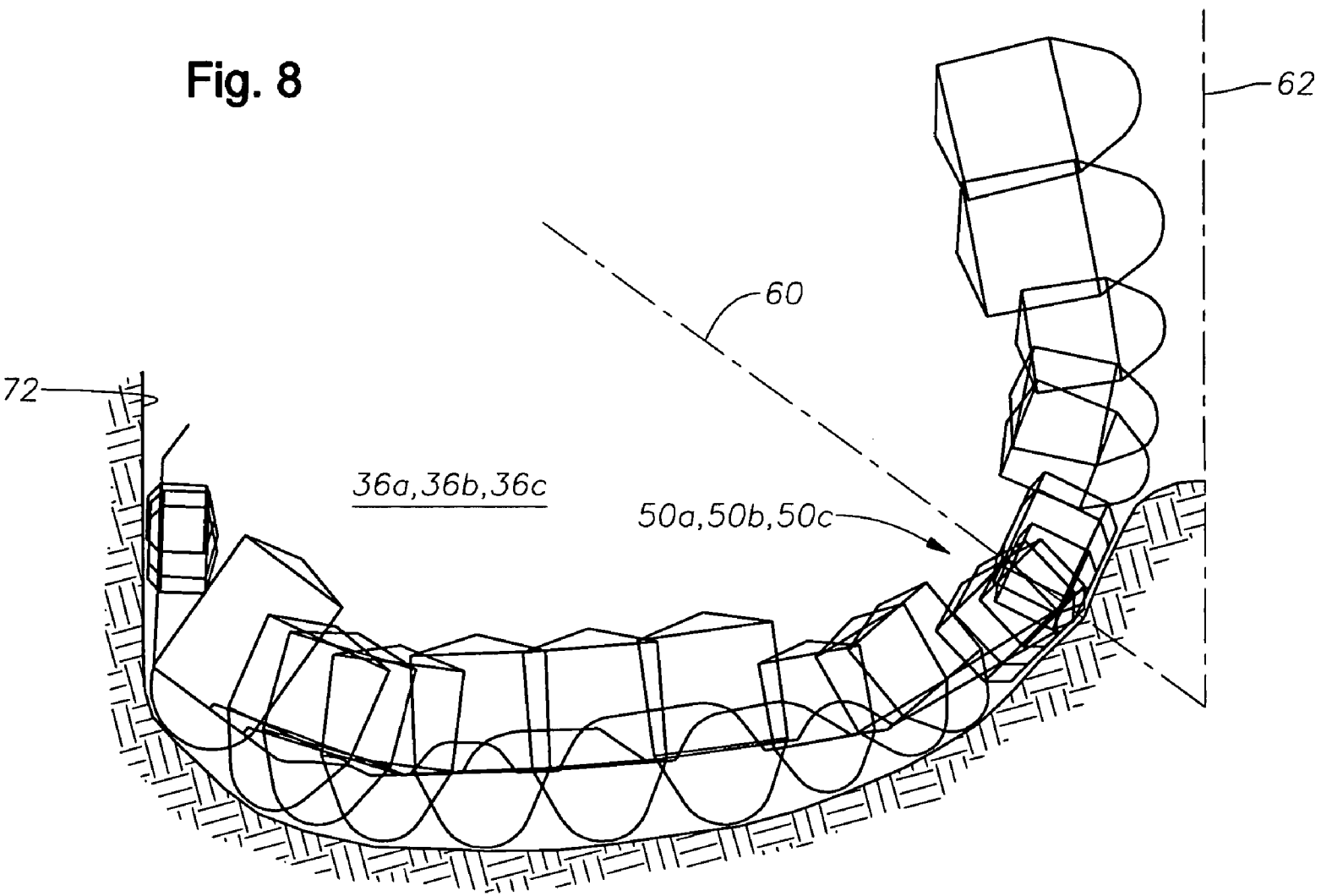
FIG. 8 is a sectional layout of the bit of FIG. 2, with all three cones shown rotated into a single plane.

In operation, as the bit rotates around bit axis 62, cones 36*a*, 36*b*, and 36*c* will rotate around their axes 60. Nose inserts 50*a*, 50*b*, and 50*c* perform mostly shearing action due to the rotation of the bit body about axis 62 and their close proximity to each cone axis 50. FIG. 8 illustrates all three cones 36*a*, 36*b* and 36*c* rotated into the same plane, and also schematically illustrating the borehole bottom. A central core tends to build up in the central portion of the bit around bit axis 62. The flat outer ends of nose inserts 50*a*, 50*b* and 50*c* are arranged to be approximately parallel to the central core for reducing the build-up of the central core. Nose inserts 50*a*, 50*b* and 50*c* incline at different amounts relative to each cone axis 60 and are spaced at different distances from bit axis 62 to form the contour of the central core.

Figure 7:
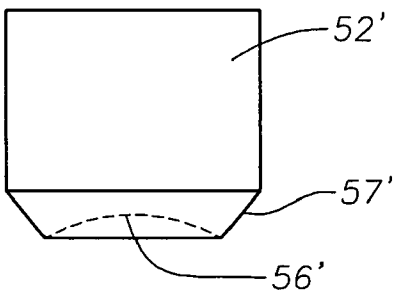
FIG. 7 is a side view of one of the nose inserts used in the cones of FIG. 2.

FIG. 7 illustrates an alternate embodiment for each nose insert 50*a*, 50*b* and 50*c*. Nose insert 50' has a cylindrical barrel 52' and a cutting end with a conical bevel 57' and an outer end 56' that has a circular perimeter. A single plane contains the circular perimeter, and the axis of barrel 52' is normal to this plane and passes through the centerpoint of outer end 56'. Outer end 56' is not flat, rather it is concave, as indicated by the dotted lines. Preferably, the depression formed by outer end 56' is a portion of a sphere. The depth of outer end 56' may vary, but preferably does not extend into barrel 52'. The depression of outer end 56' serves as a relieved area for the passage of cuttings of the earth formation.

The invention has significant advantages. The nose area cutting elements better perform shearing action due to rotation about the bit axis, rather than rotation of the cone about the cone axis. The nose area inserts are more efficient in reaming out the central core of the borehole than the prior art rounded cutting elements. The shapes and material of the nose inserts make them highly wear resistant.

While the invention has been shown in only two of its forms, it should be apparent to those skilled in the art that it is not so limited but is susceptible to various changes without departing from the scope of the invention. For example, although nose inserts 50, heel row inserts 44, inner row inserts 46 are press-fitted into mating holes in the preferred embodiment, the principles regarding nose inserts 50 could also be applied to steel teeth bits. The nose cutting elements in that instance would be machined from the cone metal. Also, more than one nose cutting element with a flat or concave outer end could be located on the blunted apex of each cone.

The invention claimed is:

1. An earth-boring bit, comprising:

a bit body having a bit axis of rotation;

at least one cone carried by the bit body for rotation relative to the bit body, the cone having a nose area adjacent the bit axis;

the cone having cutting elements located thereon;

a nose cutting element in the nose area and projecting outwardly therefrom, the nose cutting element being located closer to the bit axis than any other of the cutting elements;

the nose cutting element having an outer end with a circular perimeter located in a single plane perpendicular to an axis of the nose cutting element and a conical surface that intersects the circular perimeter of the outer end; and wherein the conical surface and the outer end are symmetrical about the axis of the nose cutting element.

2. The bit according to claim 1, wherein the outer end is flat.

3. The bit according to claim 1, wherein the outer end is concave.

4. The bit according to claim 1, wherein the axis of the cutting element is at an angle relative to an axis of rotation of the cone that is in the range from 0 to 35 degrees.

5. An earth-boring bit, comprising:

a bit body having a bit axis of rotation;

at least one cone carried by the bit body for rotation relative to the bit body about a cone axis, the cone having gage surface and a nose area separated by a central area;

a plurality of rows of central area inserts mounted in holes in the central area of the cone, each of the central area inserts having a cutting end protruding from the cone; and a nose insert in the nose area, the nose insert being closer to the bit axis that any of the central area inserts, the nose insert having a barrel located within a hole in the nose area and an outer end separated from the barrel by a straight frusto-conical surface, the outer end having a circular perimeter that is in a single plane;

the straight frusto-conical surface of the nose insert intersecting the circular perimeter of the outer end;

the outer end and the straight frusto-conical surface being symmetrical about an axis of the barrel; and wherein the amount of protrusion of the outer end from the hole is less than the protrusion of the cutting end of any of the central area inserts.

6. The bit according to claim 5, wherein the outer end is flat.

7. The bit according to claim 5, wherein the outer end is concave.

8. The bit according to claim 5, wherein the barrel has an axis that is at an angle from zero to 35 degrees relative to the cone axis.

9. The bit according to claim 5, wherein the barrel has an axis that is concentric with the circular perimeter of the outer end.

10. An earth-boring bit, comprising:

a bit body having a bit axis of rotation;

first, second, and third cones carried by the bit body for rotation relative to the bit body about a cone axis, each of the cones having gage surface and a nose area separated by a central area;

inserts mounted in mating holes in each of the cones; and each of the cones having a nose insert in the nose area of each of the cones that is located closer to the bit axis than any other inserts mounted to the same cone, each of the nose inserts having a barrel located within a hole in the nose area of one of the cones, a conical surface protruding from the hole, and an outer end located substantially in a single plane that is intersected by the conical surface, the barrel having an axis that passes through the outer end normal to the outer end, the outer end and the conical surface being symmetrical about the axis of the barrel.

11. An earth-boring bit, comprising:

a bit body having a bit axis of rotation;

first, second, and third cones carried by the bit body for rotation relative to the bit body about a cone axis, each of the cones having gage surface and a nose area separated by a central area;

inserts mounted in mating holes in each of the cones;

each of the cones having a nose insert in the nose area of each of the cones that is located closer to the bit axis than any other inserts mounted to the same cone, each of the nose inserts having a barrel located within a hole in the nose area of one of the cones, a conical surface protruding from the hole, and an outer end located substantially in a single plane that is intersected by the conical surface, the barrel having an axis that passes through the outer end normal to the outer end, the outer end and the conical surface being symmetrical about the axis of the barrel; wherein:

the outer end of each of the nose inserts has a center point;

the center point of the outer end of the nose insert of the first cone is closer to the cone axis of the first cone than the center point of the outer end of the nose insert of the second cone to the cone axis of the second cone; and the center point of the outer end of the nose insert of the second cone is closer to the cone axis of the second cone than the center point of the outer end of the nose insert of the third cone to the cone axis of the third cone.

12. The bit according to claim 11, wherein the outer end of at least one of the nose inserts is flat.

13. The bit according to claim 11, wherein the outer end of at least one of the nose inserts is concave.

14. The bit according to claim 11, wherein the barrel axis of each of the nose inserts is an angle relative to the cone axis of its cone that is from zero to 35 degrees.

* * * * *

UNITED STATES PATENT AND TRADEMARK OFFICE

CERTIFICATE OF CORRECTION

PATENT NO. : 7,673,709 B2
APPLICATION NO. : 11/393298
DATED : March 9, 2010
INVENTOR(S) : Floyd C. Felderhoff et al.

It is certified that error appears in the above-identified patent and that said Letters Patent is hereby corrected as shown below:

Column 2, line 62, delete "be curved" before "when"

Signed and Sealed this

Twenty-second Day of June, 2010

David J. Kappos

David J. Kappos
*Director of the United States Patent and Trademark Office*